US012345485B2

(12) United States Patent
Dunn

(10) Patent No.: US 12,345,485 B2
(45) Date of Patent: Jul. 1, 2025

(54) PISTOL SLIDE RESTRAINING TOOL

(71) Applicant: Michael Fredric Dunn, Estero, FL (US)

(72) Inventor: Michael Fredric Dunn, Estero, FL (US)

( * ) Notice: Subject to any disclaimer, the term of this patent is extended or adjusted under 35 U.S.C. 154(b) by 0 days.

(21) Appl. No.: 18/757,024

(22) Filed: Jun. 27, 2024

(65) Prior Publication Data

US 2025/0060181 A1 Feb. 20, 2025

Related U.S. Application Data

(60) Provisional application No. 63/533,379, filed on Aug. 18, 2023.

(51) Int. Cl.
*F41C 27/00* (2006.01)
*F41A 11/00* (2006.01)
*F41G 1/54* (2006.01)

(52) U.S. Cl.
CPC ..... *F41A 11/00* (2013.01); *F41C 27/00* (2013.01); *F41G 1/545* (2013.01)

(58) Field of Classification Search
CPC ..... F41A 11/00; F41A 35/00; F41C 27/00; F41G 1/545
USPC ..... 42/90, 106
See application file for complete search history.

(56) References Cited

U.S. PATENT DOCUMENTS

| | | | | |
|---|---|---|---|---|
| 4,438,913 | A * | 3/1984 | Hylla | B25H 1/00 269/296 |
| 5,111,608 | A * | 5/1992 | Weisheit | F41A 15/22 42/106 |
| 5,864,957 | A * | 2/1999 | Small | F41G 1/54 42/134 |
| 8,397,422 | B2 * | 3/2013 | Bietsch | F41G 1/545 33/274 |
| 8,707,609 | B2 * | 4/2014 | Fisher | F41C 27/00 33/274 |
| 9,616,552 | B1 * | 4/2017 | McClain | B25B 5/163 |
| 10,890,393 | B1 * | 1/2021 | Schoettle | F41A 15/22 |
| 10,940,570 | B2 * | 3/2021 | Chang | B25H 1/10 |
| 11,226,174 | B1 * | 1/2022 | Chen | F41G 1/545 |
| D960,679 | S * | 8/2022 | Zhou | D22/108 |
| 12,018,916 | B1 * | 6/2024 | Morris | F41G 1/545 |
| 12,097,593 | B2 * | 9/2024 | Morris | B25B 5/102 |

(Continued)

*Primary Examiner* — Joshua E Freeman
(74) *Attorney, Agent, or Firm* — Bennet K. Langlotz; Langlotz Patent & Trademark Works, LLC

(57) ABSTRACT

A pistol slide restraining tool has a frame, a first restraint element connected to the frame and configured to engage a lower portion of the downwardly-extending grip, a second restraint element connected to the frame at a level above the first restraint element and configured to engage a rear portion of the downwardly-extending grip at an intermediate position above the lower portion of the downwardly-extending grip, a third restraint element connected to the frame and having a slide engagement facility configured to selectably engage the reciprocating slide, and the third restraint element being connected to the frame by an adjustable element operable to move the reciprocating slide from a forward battery position to a rearward recoil position and to restrain the reciprocating slide in the recoil position. The first restraint element may engage a forward-facing portion of the downwardly-extending grip.

10 Claims, 4 Drawing Sheets

(56) References Cited

U.S. PATENT DOCUMENTS

| | | | | |
|---|---|---|---|---|
| 2011/0167702 | A1* | 7/2011 | Bietsch | F41G 1/545<br>254/1 |
| 2012/0005937 | A1* | 1/2012 | Milino | F41A 23/18<br>42/108 |
| 2013/0255128 | A1* | 10/2013 | Fisher | F41G 1/545<br>42/108 |
| 2017/0095907 | A1* | 4/2017 | McClain | F41A 29/00 |
| 2017/0368652 | A1* | 12/2017 | Chang | B23Q 3/005 |
| 2019/0168346 | A1* | 6/2019 | Chang | B25H 1/10 |

* cited by examiner

PISTOL SLIDE RESTRAINING TOOL

CROSS-REFERENCE TO RELATED APPLICATION

This application claims the benefit of U.S. Provisional Patent Application No. 63/533,379 filed on Aug. 18, 2023, entitled "SLIDE RACKING APPARATUS TO AID IN HANDGUN DISASSEMBLY," which is hereby incorporated by reference in its entirety for all that is taught and disclosed therein.

FIELD OF THE INVENTION

The present invention relates to firearms, and more particularly to a pistol slide restraining tool that enables the slide of a pistol to be retracted easily and held at a specified position.

BACKGROUND AND SUMMARY OF THE INVENTION

Handguns of the hammer-fired type often require retraction of the slide to a particular position to align a notch in the slide with the slide release lever head for disassembly. Once the notch and slide release lever head are aligned, the slide release lever head can be pushed out from the opposite side, allowing the slide to be slid forward. Retracting the slide conventionally requires significant hand strength to compress the recoil spring and to hold the slide immobile with one hand while pushing the slide release pin out with the other hand. Removal of the slide release pin sometimes requires turning the pistol over and using a punch begin the process, which requires further manual dexterity.

While there are a few pistols with weaker recoil springs to make it easier for those with weaker or injured hands to perform these tasks, this is not a feature of most pistols. For owners of pistols with conventionally strong recoil springs, they are faced with the potentially undesirable choice of changing pistols should their hand strength or dexterity decline.

Therefore, a need exists for a new and improved pistol slide restraining tool that enables the slide of a pistol to be retracted easily and held at a specified position. In this regard, the various embodiments of the present invention substantially fulfill at least some of these needs. In this respect, the pistol slide restraining tool according to the present invention substantially departs from the conventional concepts and designs of the prior art, and in doing so provides an apparatus primarily developed for the purpose of enabling the slide of a pistol to be retracted easily and held at a specified position.

The present invention provides an improved pistol slide restraining tool, and overcomes the above-mentioned disadvantages and drawbacks of the prior art. As such, the general purpose of the present invention, which will be described subsequently in greater detail, is to provide an improved pistol slide restraining tool that has all the advantages of the prior art mentioned above.

To attain this, the preferred embodiment of the present invention essentially comprises a frame, a first restraint element connected to the frame and configured to engage a lower portion of the downwardly-extending grip, a second restraint element connected to the frame at a level above the first restraint element and configured to engage a rear portion of the downwardly-extending grip at an intermediate position above the lower portion of the downwardly-extending grip, a third restraint element connected to the frame and having a slide engagement facility configured to selectably engage the reciprocating slide, and the third restraint element being connected to the frame by an adjustable element operable to move the reciprocating slide from a forward battery position to a rearward recoil position and to restrain the reciprocating slide in the recoil position. The first restraint element may engage a forward-facing portion of the downwardly-extending grip. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
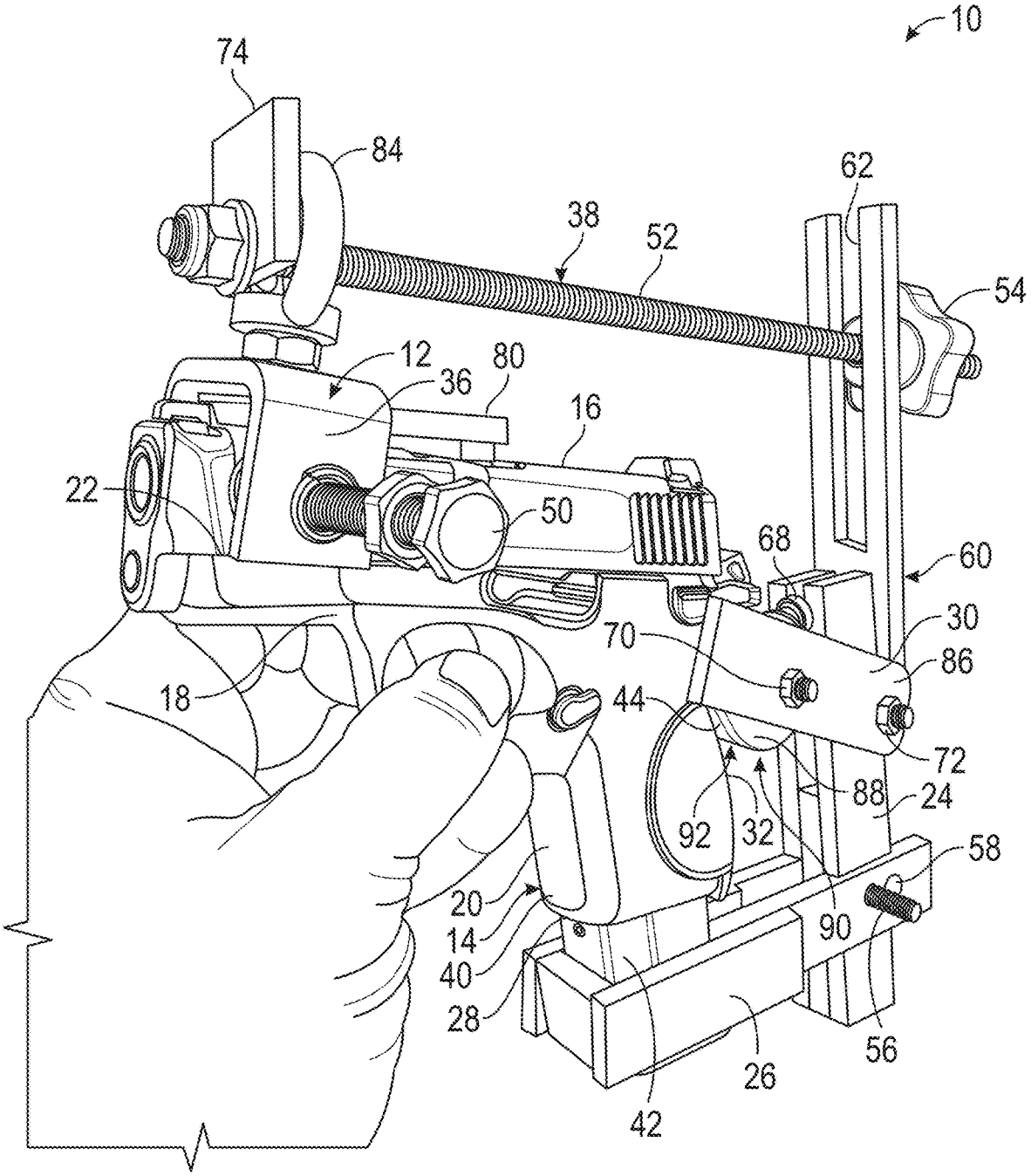
FIG. 1 is a front perspective view of the current embodiment of a pistol slide restraining tool constructed in accordance with the principles of the present invention in use attached to a pistol with the reciprocating slide in the forward battery position.

An embodiment of the pistol slide restraining tool of the present invention is shown and generally designated by the reference numeral 10.

Figure 2:
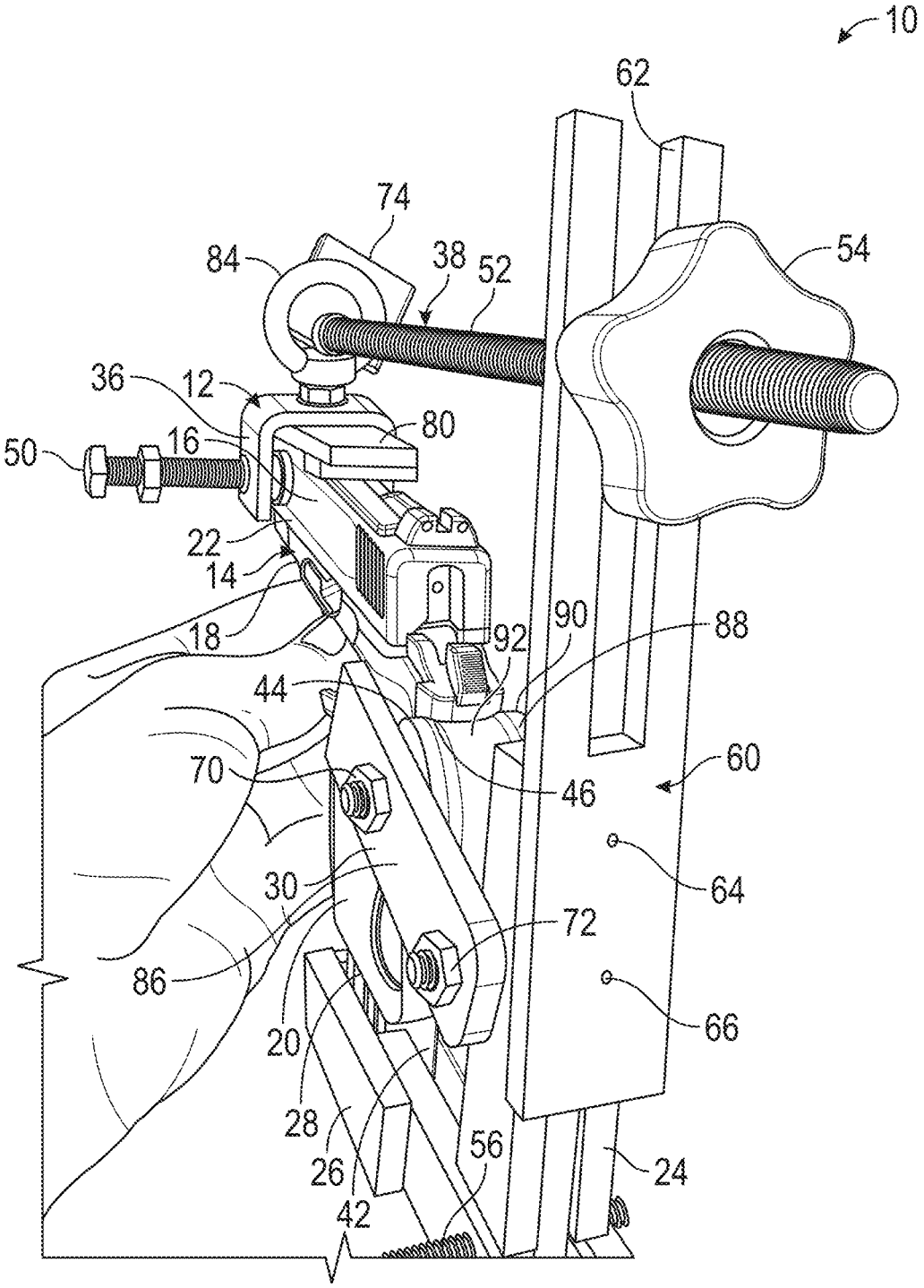
FIG. 2 is a rear perspective view of the pistol slide restraining tool of FIG. 1 in use attached to a pistol with the reciprocating slide in the rearward recoil position.
Figure 3:
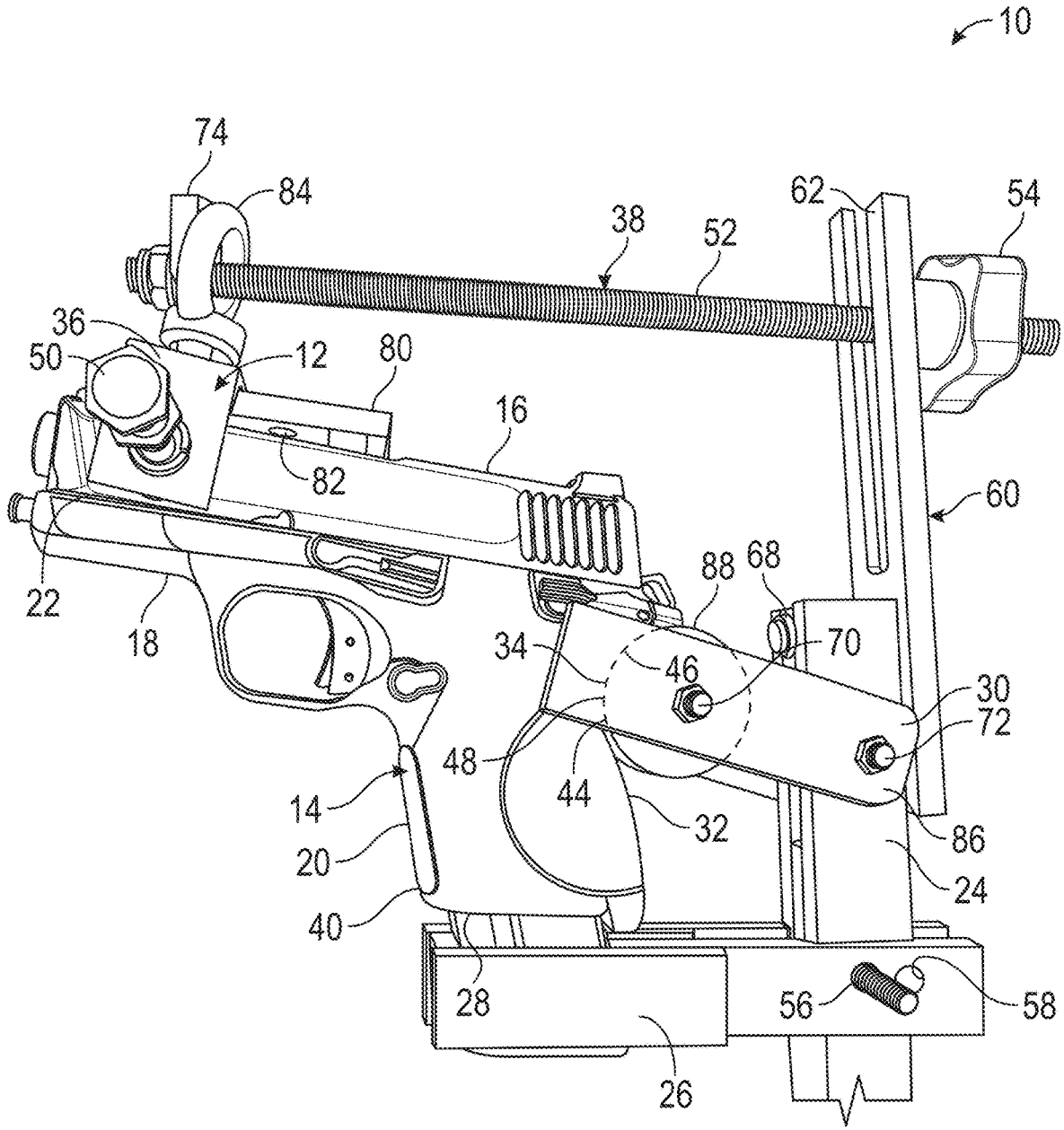
FIG. 3 is a left side view of the pistol slide restraining tool of FIG. 1 in use attached to a pistol with the reciprocating slide in the rearward recoil position.
Figure 4:
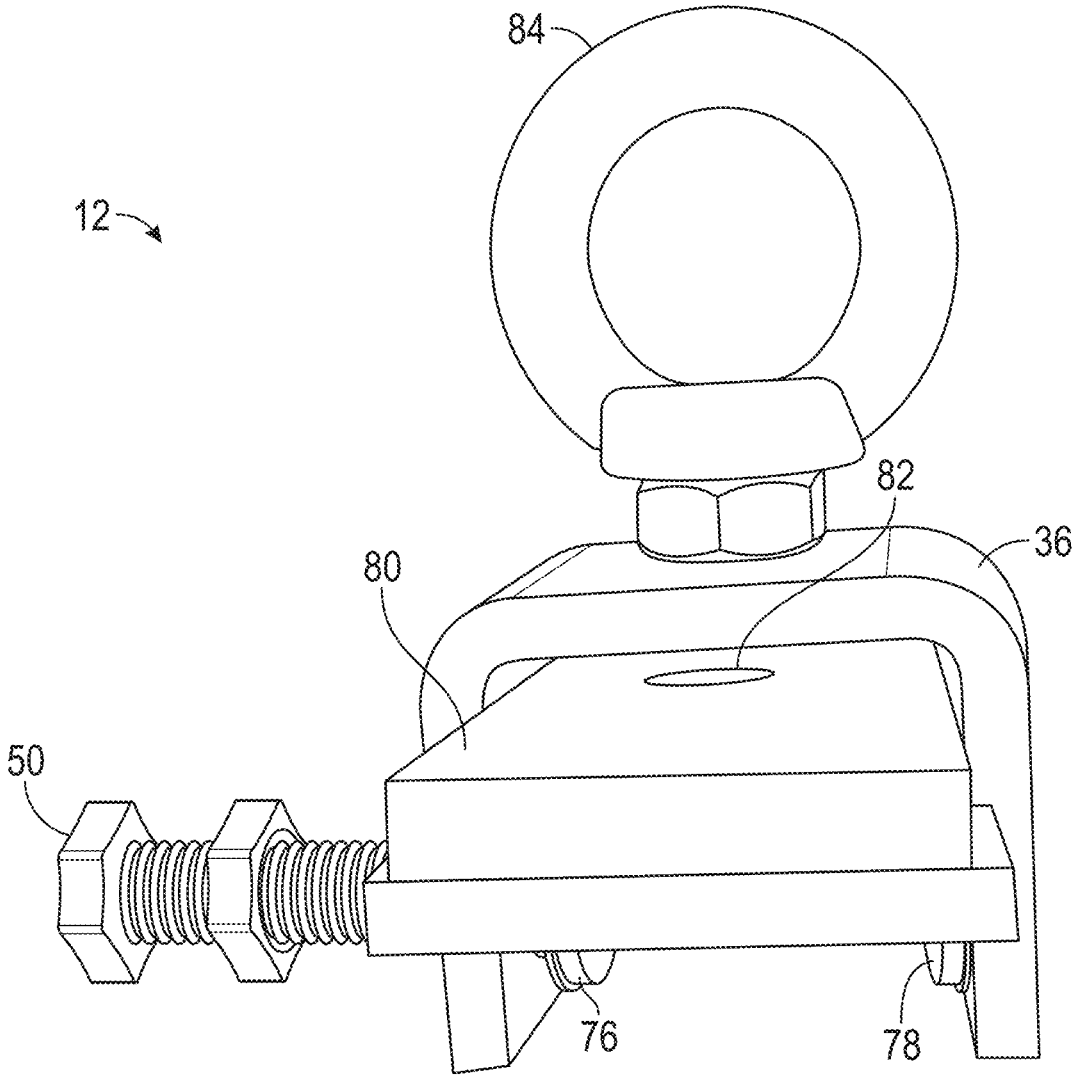
FIG. 4 is a rear enlarged view of the third restraint element of the pistol slide restraining tool of FIG. 1.

FIGS. 1-3 illustrate the improved pistol slide restraining tool 10 of the present invention. FIG. 4 illustrates the improved third restraint element 12 of the present invention. More particularly, FIG. 1 shows the pistol slide restraining tool in use attached to a pistol 14 with a reciprocating slide 16 in the forward battery position. FIGS. 2 & 3 show the pistol slide restraining tool in use attached to the pistol with the reciprocating slide in the rearward recoil position. The pistol includes a pistol frame 18 with a downwardly-extending grip 20. The reciprocating slide is located at an upper portion 22 of the pistol frame.

The pistol slide restraining tool 10 has a frame 24. A first restraint element 26 is connected to the frame and is configured to engage a lower portion 28 of the downwardly-extending grip 20. A second restraint element 30 is connected to the frame at a level above the first restraint element and is configured to engage a rear portion 32 of the downwardly-extending grip at an intermediate position 34 above the lower portion of the downwardly-extending grip. This location is where the web between the thumb and index finger are placed when holding the pistol during firing. The third restraint element 12 is connected to the frame and has a slide engagement facility 36 configured to selectably engage the reciprocating slide. The third restraint element is connected to the frame by an adjustable element 38 operable to move the reciprocating slide from a forward battery position (shown in FIG. 1) to a rearward recoil position (shown in FIGS. 2 & 3) and to restrain the reciprocating slide in the recoil position.

The first restraint element 26 engages a forward-facing portion 40 of the downwardly-extending grip 20. The first restraint element engages a magazine 42 in the downwardly-extending grip in the current embodiment, but can also engage a magazine well plug (not shown) substituted for the magazine. The second restraint element 30 faces forward in the current embodiment and has a convex shape 44 configured to engage a concave portion 46 of the downwardly-extending grip. The concave portion of the downwardly-extending grip has a vertical portion 48 engaged by the second restraint element. In the current embodiment, the second restraint element includes two planar elements (only planar element 86 is visible) joined by threaded rod with nut 72. The second restraint element also includes a disc 88 with a convex outer portion 90 and a concave portion 92 such that the disc resembles a pulley wheel. The second restraint element is secured by threaded rod with nut 72 to the two planar elements. The disc engages the concave portion of the downwardly-extending grip where the thumb and index finger web of the user's hand would be placed. The slide engagement facility 36 includes an adjustable clamp 50 operable to selectably grip the reciprocating slide 16. The adjustable element 38 includes a threaded rod 52 and a nut 54 engaging the threaded rod. The nut is operable to retract the reciprocating slide in response to clockwise rotation of the nut.

The first restraint element 26 includes multiple apertures 56, 58 for connecting the first restraint element to the frame 24 to accommodate pistols of varying size. The third restraint element 12 includes a vertical brace 60. The vertical brace defines a vertical slot 62 to enable the clamp to horizontally engage the slides of pistols of varying size, or to accommodate a mounted optic. The vertical brace receives pins 64, 66 to enable the vertical brace to be adjustable vertically and then fixed in place. Pin 64 includes a screw head 68 to facilitate adjustment. Pin 66 omits a screw head to prevent interference with the second restraint element 30 during adjustment. Two threaded rods with nuts 70, 72 are received by the second restraint element 30. These provide rigidity to the pistol slide retaining tool 10 once the pistol slide retaining tool is affixed to the pistol 14. The third restraint element 12 includes a washer 74. The washer allows flexibility of placement of the threaded rod 38. The third restraint element also includes two gripping pads 76, 78, which prevent marring of the pistol's finish. The third restraint element also includes an insert 80 that defines an aperture 82. The insert prevents the third restraint element from rocking clockwise when advancing toward the rear of the pistol as the nut 54 is rotated. The aperture receives the extended threaded portion of an eyelet 84 to retain the insert within the slide engagement facility. In FIG. 4, the insert is shown partially withdrawn rearwardly to expose the aperture.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a pistol slide restraining tool has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for restraining a slide of a pistol having a pistol frame with a downwardly-extending grip and a reciprocating slide at an upper portion of the pistol frame, the tool comprising:

a frame;

a first restraint element connected to the frame and configured to engage a lower portion of the downwardly-extending grip;

a second restraint element connected to the frame at a level above the first restraint element and configured to engage a rear portion of the downwardly-extending grip at an intermediate position above the lower portion of the downwardly-extending grip;

a third restraint element connected to the frame and having a slide engagement facility configured to selectably engage the reciprocating slide; and the third restraint element being connected to the frame by an adjustable element operable to move the reciprocating slide from a forward battery position to a rearward recoil position and to restrain the reciprocating slide in the recoil position.

2. The tool of claim 1 wherein the first restraint element engages a forward-facing portion of the downwardly-extending grip.

3. The tool of claim 2 wherein the first restraint element engages a magazine in the downwardly-extending grip.

4. The tool of claim 2 wherein the first restraint element engages a portion of the downwardly-extending grip.

5. The tool of claim 1 wherein the second restraint element faces forward.

6. The tool of claim 1 wherein the second restraint element has a convex shape configured to engage a concave portion of the downwardly-extending grip.

7. The tool of claim 6 wherein the concave portion of the downwardly-extending grip has a vertical portion engaged by the second restraint element.

8. The tool of claim 1 wherein the slide engagement facility includes an adjustable clamp operable to selectably grip the reciprocating slide.

9. The tool of claim 1 wherein the adjustable element includes a threaded rod.

10. The tool of claim 9 including a nut engaging the threaded rod and operable to retract the reciprocating slide in response to rotation of the nut.

* * * * *